US010425993B2

(12) United States Patent
Slane et al.

(10) Patent No.: US 10,425,993 B2
(45) Date of Patent: Sep. 24, 2019

(54) CARBON NANOTUBE YARN HEATER

(71) Applicant: Goodrich Corporation, Charlotte, NC (US)

(72) Inventors: Casey Slane, Richwood, OH (US); Jin Hu, Hudson, OH (US); Galdemir Cezar Botura, Akron, OH (US); Nathaniel Ching, Uniontown, OH (US)

(73) Assignee: Goodrich Corporation, Charlotte, NC (US)

( * ) Notice: Subject to any disclaimer, the term of this patent is extended or adjusted under 35 U.S.C. 154(b) by 15 days.

(21) Appl. No.: 15/373,368

(22) Filed: Dec. 8, 2016

(65) Prior Publication Data

US 2018/0168002 A1 Jun. 14, 2018

(51) Int. Cl.

| | |
|---|---|
| ***H05B 3/12*** | (2006.01) |
| ***H05B 3/14*** | (2006.01) |
| ***H05B 3/20*** | (2006.01) |
| ***H05B 3/28*** | (2006.01) |
| ***H05B 3/34*** | (2006.01) |

(52) U.S. Cl.

CPC ..... *H05B 3/145* (2013.01); *H05B 3/34* (2013.01); *H05B 3/347* (2013.01); *H05B 2203/003* (2013.01); *H05B 2203/015* (2013.01); *H05B 2203/017* (2013.01); *H05B 2214/02* (2013.01); *H05B 2214/03* (2013.01); *H05B 2214/04* (2013.01)

(58) Field of Classification Search

CPC ... H05B 3/10; H05B 3/12; H05B 3/14; H05B 3/145; H05B 3/146; H05B 3/20; H05B 3/28

See application file for complete search history.

(56) References Cited

U.S. PATENT DOCUMENTS

| | | | | |
|---|---|---|---|---|
| 3,193,664 | A | 7/1965 | Beery | |
| 6,682,677 | B2 | 1/2004 | Lobovsky et al. | |
| 8,926,933 | B2 | 1/2015 | Zhang et al. | |
| 2003/0210902 | A1 | 11/2003 | Giamati | |
| 2009/0314765 | A1 | 12/2009 | Feng et al. | |
| 2010/0122980 | A1* | 5/2010 | Wang | H05B 3/145 219/553 |
| 2010/0129654 | A1* | 5/2010 | Jiang | B82Y 30/00 428/367 |
| 2010/0155538 | A1 | 6/2010 | Calder et al. | |
| 2011/0036828 | A1* | 2/2011 | Feng | H05B 3/342 219/529 |

(Continued)

OTHER PUBLICATIONS

Extended European Search Report for EP Serial No. 17206115.2, dated May 9, 2018, 8 Pages.

*Primary Examiner* — Michael A Laflame, Jr.
(74) *Attorney, Agent, or Firm* — Kinney & Lange, P.A.

(57) ABSTRACT

A heating element includes a bottom layer, a web consisting of a carbon nanotube (CNT) yarn wherein the web is affixed to a first side of the bottom layer, and an encapsulating layer positioned on the web and the first side of the bottom layer. A method for making a heating element includes providing a bottom layer, inserting a plurality of pegs into the bottom layer such that a portion of each peg protrudes from the bottom layer, weaving a CNT yarn around the protruding portions of the plurality of pegs to form a CNT web, affixing the CNT web to the bottom layer, and encapsulating the CNT web and the bottom layer to form the heating element.

16 Claims, 2 Drawing Sheets

(56) References Cited

U.S. PATENT DOCUMENTS

| | | | | |
|---|---|---|---|---|
| 2011/0204038 | A1* | 8/2011 | Feng | H05B 3/28 219/213 |
| 2012/0118868 | A1* | 5/2012 | Kim | B62D 1/065 219/204 |
| 2012/0125914 | A1* | 5/2012 | Yue | H05B 3/34 219/548 |
| 2014/0014640 | A1* | 1/2014 | Calder | B64D 15/12 219/202 |
| 2014/0034633 | A1* | 2/2014 | Heintz | H05B 3/565 219/525 |
| 2014/0175087 | A1* | 6/2014 | Feng | H05B 1/0238 219/494 |
| 2014/0263278 | A1* | 9/2014 | Zakhidov | H05B 3/10 219/472 |
| 2015/0344138 | A1 | 12/2015 | Wen et al. | |
| 2015/0366005 | A1 | 12/2015 | Janas et al. | |
| 2015/0373782 | A1* | 12/2015 | Kang | H05B 3/34 219/541 |
| 2016/0201229 | A1* | 7/2016 | Yano | D01H 1/115 57/333 |

* cited by examiner

CARBON NANOTUBE YARN HEATER

BACKGROUND

Carbon nanotubes (CNTs) are carbon allotropes having a generally cylindrical nanostructure. They have unusual properties that make them valuable for many different technologies. For instance, some CNTs can have high thermal and electrical conductivity, making them suitable for replacing metal heating elements. Due to their much lighter mass, substituting CNTs for metal heating components can reduce the overall weight of a heating component significantly. This makes the use of CNTs of particular interest for applications where weight is critical, such as in aerospace and aviation technologies.

Carbon nanotubes are commercially available in several different forms. One such form is as a CNT yarn. Carbon nanotube yarn includes aligned bundles of CNTs that are hundreds of microns in diameter and millimeters long. In a CNT yarn, carbon nanotubes are spun into long fibers and can be plied together or stretched to provide the desired length and mechanical properties.

However, while CNT yarns have been used in heating elements, they have first been incorporated into a substrate film. Incorporating the CNT yarn into a film reduces some of the flexibility that CNTs provide. For example, CNT films typically contain air voids that increase the electrical resistivity (and reduce the conductivity) of the CNT film. As a result, CNT yarns incorporated into a film may not provide the level of electrical resistivity necessary for many aerospace heating applications (e.g., anti-icing and de-icing). Thus, forming a film with a commercially available CNT yarn cannot currently be used as a substitute for metal heating elements.

SUMMARY

A heating element includes a bottom layer, a web consisting of a carbon nanotube (CNT) yarn wherein the web is affixed to a first side of the bottom layer, and an encapsulating layer positioned on the web and the first side of the bottom layer.

A method for making a heating element includes providing a bottom layer, inserting a plurality of pegs into the bottom layer such that a portion of each peg protrudes from the bottom layer, weaving a CNT yarn around the protruding portions of the plurality of pegs to form a CNT web, affixing the CNT web to the bottom layer, and encapsulating the CNT web and the bottom layer to form the heating element.

DETAILED DESCRIPTION

Figure 1A:
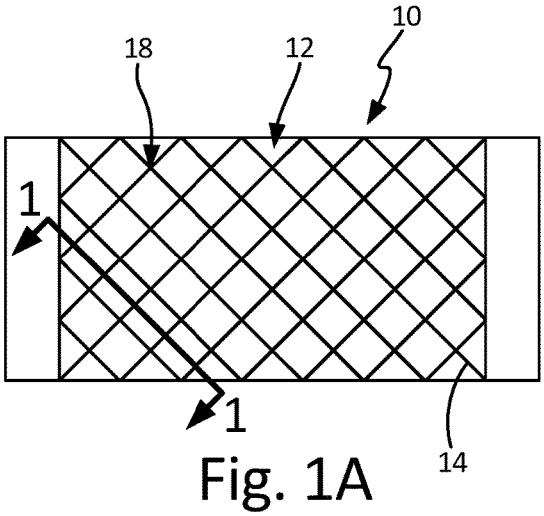
FIG. 1A is a schematic top view of a first embodiment of a CNT yarn heating element.
Figure 1B:
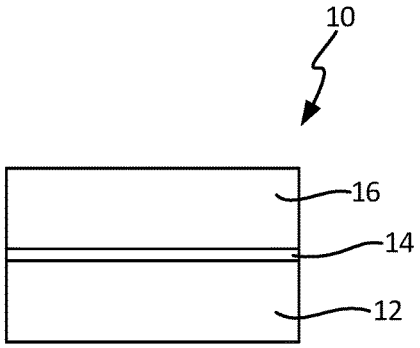
FIG. 1B is a side view of the heating element shown in FIG. 1A.

The present disclosure provides a heating element employing a carbon nanotube (CNT) yarn. Unlike in other CNT heating elements, CNT yarn according to the present disclosure is not applied as a film and then integrated into a heating element, but rather the CNT yarn itself (in strand form) is wound or woven and affixed to a bottom layer and incorporated into the heating element. By utilizing the CNT yarn itself, rather than as a film, CNT particles in the yarn are able to align themselves in the direction of current flow to provide a lower electrical resistivity than CNT film heating elements.

Carbon nanotube yarn is a flexible collection of connected CNT particles that form a thread-like structure. A strand of CNT yarn has a much larger length than its diameter. For example, a single strand of CNT yarn can have a diameter of about 150 micrometers and a length of several millimeters, centimeters or longer. The diameter of a strand of CNT yarn can be influenced by its manufacturing parameters. Carbon nanotube yarn can be manufactured to have a smaller or larger diameter than 150 μm. The electrical resistivity of CNT yarn can be modified by modifying its diameter and/or length. Additionally, multiple strands of CNT yarn can be woven or braided together to form a cable-like structure. Creating a CNT "cable" can also be used to modify the electrical resistivity of the CNT structure. As described in the embodiments disclosed herein, CNT yarn can refer to both individual strands of CNT yarn as well as to multiple strands of CNT yarn braided, woven or grouped together to form a cable-like structure. Whether the CNT yarn is an individual strand, a braided cable, etc. will depend on the desired electrical resistivity of the heating element and its intended application. Generally speaking, a single CNT thread will have a lower electrical resistivity than a braided cable that contains multiple threads having the same composition as the single CNT thread.

FIGS. 1A-D and 2 schematically illustrate different ways that CNT yarn can be utilized in a Joule heating element. Each illustrated heating element generally includes a bottom layer, one or more strands of CNT yarn, and a topping layer. For example, FIGS. 1A (top view) and 1B (side view) show a heating element having a CNT yarn mesh network. Heating element 10 includes bottom layer 12, CNT yarn 14 and topping layer 16. CNT yarn 14 is sandwiched between bottom layer 12 and topping layer 16; topping layer 16 is shown cut away in FIG. 1A.

Bottom layer 12 can be a film adhesive, a pre-impregnated fabric, a polyimide, or a neoprene, depending on the requirements of the system. In some embodiments, bottom layer 12 is attached to an external surface of an aircraft component (e.g., airfoil, strut, fairing, floor panel, etc.). The composition of bottom layer 12 is selected based on the bonding needs of the heating element 10 and the aircraft component to which it is attached. Topping layer 16 can be a film adhesive, a pre-impregnated fabric, a polyimide, or a neoprene, depending on the requirements of the system. In some embodiments, topping layer 16 faces the breeze side of an aircraft component (e.g., airfoil, strut, fairing, etc.). The composition of topping layer 16 is selected based on the external surface of the aircraft component and whether heating element 10 needs to be protected from external damage (bird strike, lightning strike, etc.). In some embodiments, an adhesive can also be applied to bottom layer 12 and/or topping layer 16 to fix the position of CNT yarn 14 to one, the other or both. Examples of suitable adhesives include epoxies, phenolic resins, polyimides and polyurethanes.

Strands of CNT yarn 14 form web 18 in between bottom layer 12 and topping layer 16. As shown in FIG. 1A, web 18 is a mesh network of strands of CNT yarn 14. Within web 18, strands of CNT yarn 14 overlap itself or other strands of CNT yarn 14. Ends of web 18 are connected to an electrical power source (not shown) and other circuit components so that when electric current is passed through web 18, the CNTs in CNT yearn 14 emit heat (via Joule heating). The mesh network of CNT yarn 14 (web 18) in heating element 10 shown in FIG. 1 provides generally uniform heating due to the generally even spacing of CNT yarn 14 within web 18 across heating element 10. Alternatively, CNT yarn 14 can be arranged in a non-uniform fashion to selectively provide heat to some areas of a component more than others.

Figure 1C:
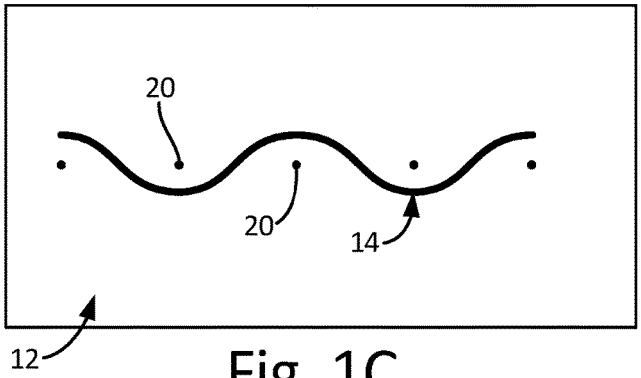
FIG. 1C is a section view of one embodiment of the CNT yarn heating element of FIG. 1A.
Figure 1D:
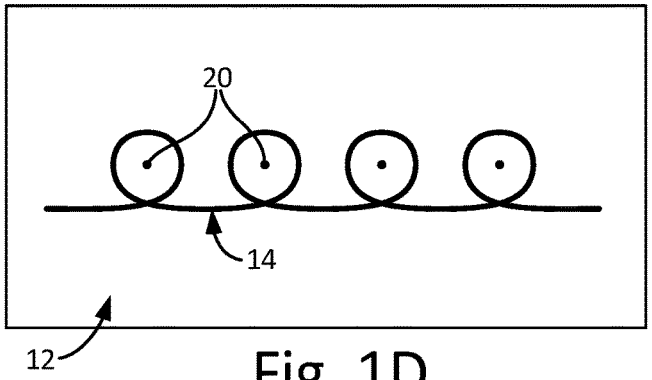
FIG. 1D is a section view of another embodiment of the CNT yarn heating element of FIG. 1A.

FIG. 1C illustrates a section view of web 18 taken along line 1-1 of FIG. 1A. FIG. 1C shows how strands of CNT yarn 14 overlap and are woven together to form web 18. Carbon nanotube yarn 14B extends into and out of the page. Carbon nanotube yarn 14B can be multiple strands or a single strand that travels in a serpentine pattern. Carbon nanotube yarn 14A extends in the left-right direction. Carbon nanotube yarn 14A passes above one strand of CNT yarn 14B and below an adjacent strand of CNT yarn 14B to form woven web 18. FIG. 1D illustrates a section view of web 18A taken along line 1-1 of FIG. 1A. In this embodiment, CNT yarn strand 14A is looped around each CNT yarn strand 14B. By weaving or looping strands of CNT yarn 14 around other strands, it is believed that better electrical connections will result in web 18 of heating element 10.

Carbon nanotube yarn 14 can also be woven (as shown in FIG. 1C) or looped (as shown in FIG. 1 D) with fabrics, films, elastomers or other materials. Alternatively, other materials can also be woven or looped around CNT yarn 14. Various patterns can be used to produce mesh, serpentine or knitted type patterns for web 18.

Unlike CNT films, CNT yarn 14 does not include air voids. The presence of air voids in a CNT film generally increases the electrical resistivity of the CNT film. Additionally, CNT films generally contain randomly oriented CNTs. Carbon nanotubes generally have cylindrical nanostructures and are semiconducting along their tubular axis. As a result, CNT films can have a relatively high resistance (about $3\times10^{-4}$ ohms-cm or greater). Because the CNTs in the film are not arranged "end-to-end", the CNTs do not conduct at their optimal level and the resistivity of the CNT film is increased. However, when CNTs are aligned such that they are generally arranged tube end-to-tube end, the CNTs conduct better and the overall resistivity of the CNT structure is reduced. When electric current is passed through CNT yarn 14, the CNTs within can become aligned tube end-to-tube end in the direction of current flow to reduce the electrical resistivity of CNT yarn 14. Thus, because CNT yarn 14 does not contain air voids and because the CNTs within CNT yarn 14 can align with the application of electric current, the electrical resistivity of web 18 can be based solely on the electrical properties of the CNTs within CNT yarn 14 (e.g., when non-conductive adhesives or no adhesives are used in heating element 10). This enables the reduction of the electrical resistivity of CNT yarn 14 and web 18, providing heating element 10 with the capability of operating effectively where low-resistance heating elements are required.

Figure 2:
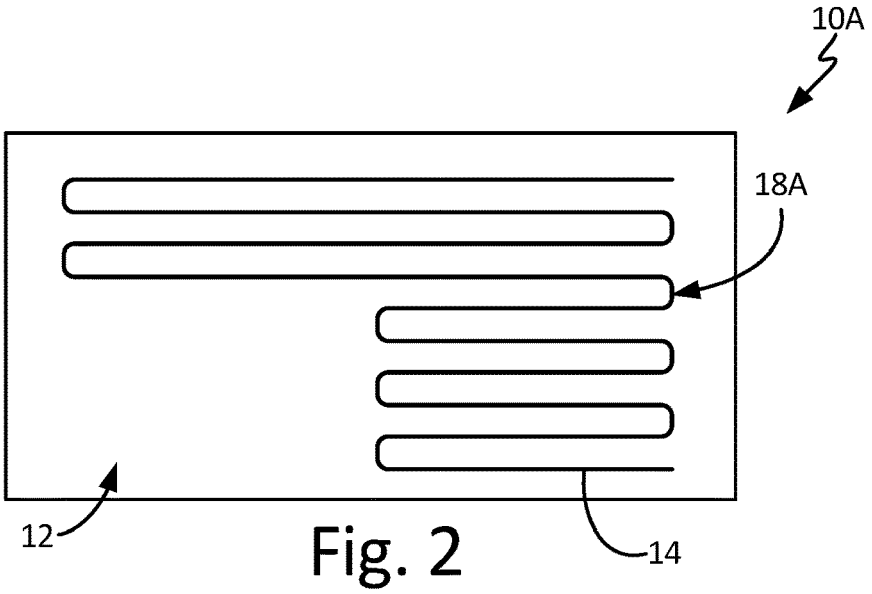
FIG. 2 is a schematic top view of a second embodiment of a CNT yarn heating element.

FIG. 2 illustrates another embodiment of a heating element having CNT yarn 14. Heating element 10A includes bottom layer 12, CNT yarn 14 and topping layer 16 (not shown). Carbon nanotube yarn 14 forms web 18A, which has a serpentine shape. Unlike web 18, web 18A is not uniform throughout heating element 10A. A portion of heating element 10A is not required to provide heat, so CNT yarn 14 is not present in that portion. Additionally, CNT yarn 14 does not overlap itself within web 18A. In webs 18 where CNT yarn 14 overlaps, the electrical resistivity can be different than in webs 18 where no CNT overlap occurs. Serpentine heating elements can also be arranged to have uniform shape and heating in addition to the non-uniform shape and non-uniform heating shown in FIG. 2. Similarly, web 18 in FIG. 1A can also be non-uniform.

Figure 3A:
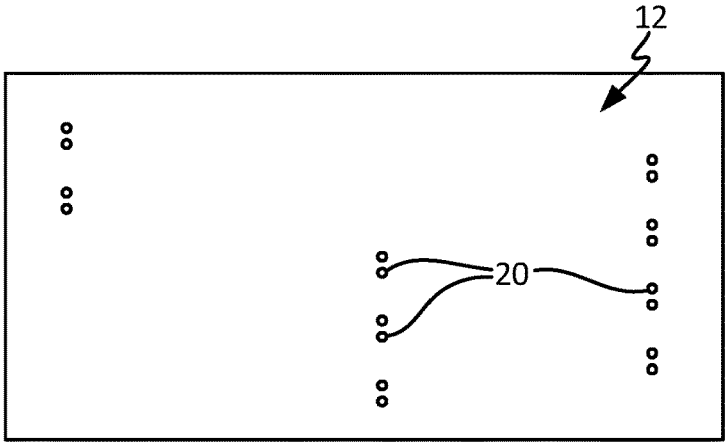
FIGS. 3A and 3B illustrate a method for forming the CNT yarn heating element shown in FIG. 2.
Figure 3B:
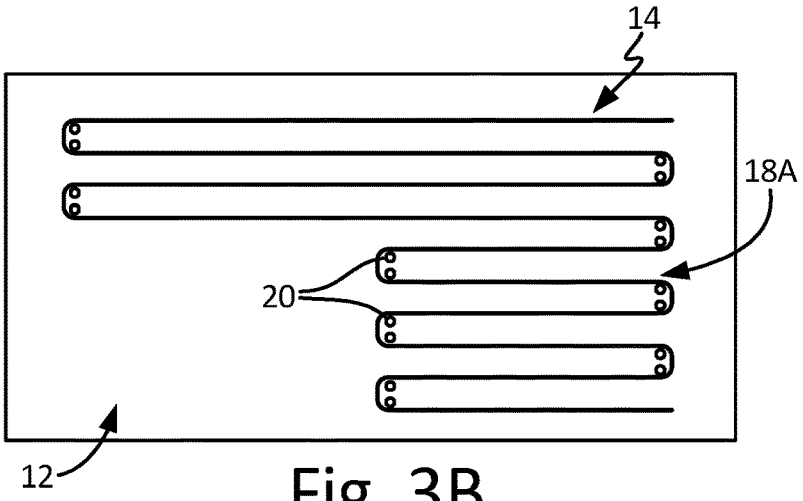

One method for forming heating element 10A is shown in FIGS. 3A and 3B. First, as shown in FIG. 3A, a number of pegs 20 are inserted into bottom layer 12. Pegs 20 are positioned where CNT yarn 14 will make a "turn" within serpentine web 18A. A portion of each peg 20 protrudes from bottom layer 12 so that CNT yarn 14 can be wrapped, weaved, wound or looped around each peg 20. In some embodiments, pegs 20 will be removed from heating element 10A before its manufacture is complete. In these cases, the composition of pegs 20 is typically not critical. Pegs 20 can be made of metal or another material strong enough to support CNT yarn 14 during winding. In other embodiments, pegs 20 can remain embedded in heating element 10A. Here, pegs 20 must be made of a material that will not compromise the structural integrity or the electrical properties of heating element 10A.

Second, CNT yarn 14 is wound around pegs 20 to form the desired shape of web 18A. Carbon nanotube yarn 14 can simply turn approximately ninety degrees around each peg 20 as shown in FIG. 3B. Alternatively, CNT yarn 14 can be wound or looped around each peg 20 once or multiple times. The number of winds or loops will have an effect on the local electrical resistivity of CNT yarn 14.

Next, CNT yarn 14 is affixed to bottom layer 12. Carbon nanotube yarn 14 can be affixed to bottom layer 12 by an adhesive material applied to CNT yarn 14 and/or bottom layer 12. An adhesive material can be applied to bottom layer 12 prior to winding CNT yarn 14 around pegs 20. During or after winding of CNT yarn 14, force is applied onto portions of CNT yarn 14 in the general direction of bottom layer 12 so that CNT yarn 14 adheres to the adhesive layer atop bottom layer 12. In some embodiments, the composition of bottom layer 12 is such that CNT yarn 14 will stick to bottom layer 12 without an adhesive. In these cases, no application of adhesive is needed; the application of force on CNT yarn 14 toward bottom layer 12 will affix CNT yarn 14 to bottom layer 12. In other embodiments, a layer of adhesive material can be applied to CNT yarn 14 and bottom layer 12 after CNT yarn 14 is wound around pegs 20.

Once CNT yarn 14 is affixed to bottom layer 12, pegs 20 can be removed from bottom layer 12 when necessary. Because CNT yarn 14 is affixed to bottom layer 12, the removal of pegs 20 does not change or upset the configuration of web 18A. Finally, an encapsulating layer (topping layer 16) is applied to CNT yarn 14 and bottom layer 12. Topping layer 16 provides the necessary structural protection to heating element 10A as described above. Following the application of topping layer 16, heating element 10A, as shown in FIG. 2, is complete and ready to be installed or further processed prior to installation.

The winding and/or weaving of CNT yarn 14 around pegs 20 can vary depending on the electrical resistivity needs, and to a lesser extent the structural needs, of heating element 10. As described above with reference to FIG. 2, CNT yarn 14 turns approximately ninety degrees around each peg 20 during formation of web 18A and does not overlap itself. In other embodiments, CNT yarn 14 has one or more overlapping strands. Pegs 20 can also be used to form a web that is a mesh network of CNT yarn.

While the instant disclosure refers particularly to carbon nanotubes, it is theorized that yarns containing other electrically conductive carbon allotropes (e.g., graphene) would behave in a similar fashion. Embodiments containing other suitable carbon allotropes are within the scope of the instant disclosure.

The structures and methods disclosed herein provide means for directly incorporating a CNT yarn into a heating element. The direct incorporation of CNT yarn (i.e. not a CNT film) enables the heating element to have a lower electrical resistivity than film-based CNT heating elements due to the lack of air voids and the ability to align CNT particles within the CNT yarn.

Discussion of Possible Embodiments

The following are non-exclusive descriptions of possible embodiments of the present invention.

A heating element can include a bottom layer, a web consisting of a carbon nanotube (CNT) yarn where the web is affixed to a first side of the bottom layer, and an encapsulating layer positioned on the web and the first side of the bottom layer.

The heating element of the preceding paragraph can optionally include, additionally and/or alternatively, any one or more of the following features, configurations and/or additional components:

The heating element can further include an adhesive connecting the web to the first side of the bottom layer.

Portions of the CNT yarn of the web can overlap.

The CNT yarn can form a plurality of loops.

The web can form a mesh network.

The web can form a generally serpentine pattern.

The CNT yarn can consist of a single strand of connected CNTs.

The CNT yarn can include a plurality of strands of connected CNTs woven together.

The mesh network can be non-uniform across the web.

A method for making a heating element can include providing a bottom layer, inserting a plurality of pegs into the bottom layer such that a portion of each peg protrudes from the bottom layer, weaving a CNT yarn around the protruding portions of the plurality of pegs to form a CNT web, affixing the CNT web to the bottom layer, and encapsulating the CNT web and the bottom layer to form the heating element.

The method of the preceding paragraph can optionally include, additionally and/or alternatively, any one or more of the following features, configurations and/or additional components:

The method can further include removing the plurality of pegs from the bottom layer after the CNT web has been affixed to the bottom layer.

The CNT yarn can be wound around at least one of the protruding portions of the plurality of pegs such that a first portion of the CNT yarn overlaps a second portion of the CNT yarn.

The CNT yarn can be woven around the protruding portions of the plurality of pegs to form a mesh network.

The CNT yarn can be woven around the protruding portions of the plurality of pegs such that the CNT yarn does not overlap itself.

The CNT web can form a generally serpentine pattern.

Affixing the CNT web to the bottom layer can include applying an adhesive to at least one of the CNT web and the bottom layer.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heating element comprising:

a bottom layer;

a web consisting of a carbon nanotube (CNT) yarn, wherein the web is affixed to a first side of the bottom layer, wherein portions of the CNT yarn of the web overlap to modify electrical resistivity compare to portions with no overlap; and an encapsulating layer positioned on the web and the first side of the bottom layer.

2. The heating element of claim 1, further comprising an adhesive connecting the web to the first side of the bottom layer.

3. The heating element of claim 1, wherein the CNT yarn forms a plurality of loops.

4. The heating element of claim 1, wherein the web forms a mesh network.

5. A heating element comprising:

a bottom layer;

a web consisting of a carbon nanotube (CNT) yarn, wherein the web is affixed to a first side of the bottom layer, wherein the web forms a generally serpentine pattern; and an encapsulating layer positioned on the web and the first side of the bottom layer.

6. The heating element of claim 1, wherein the CNT yarn consists of a single strand of connected CNTs.

7. The heating element of claim 1, wherein the CNT yarn comprises a plurality of strands of connected CNTs woven together.

8. The heating element of claim 4, wherein the mesh network is non-uniform across the web.

9. A method for making a heating element, the method comprising:

providing a bottom layer;

inserting a plurality of pegs into the bottom layer such that a portion of each peg protrudes from the bottom layer;

winding a CNT yarn around the protruding portions of the plurality of pegs to form a CNT web, wherein the CNT yarn is wound around at least one of the protruding portions of the plurality of pegs such that a first portion of the CNT yarn overlaps a second portion of the CNT yarn;

affixing the CNT web to the bottom layer; and encapsulating the CNT web and the bottom layer to form the heating element.

10. The method of claim 9, further comprising:

removing the plurality of pegs from the bottom layer after the CNT web has been affixed to the bottom layer.

11. The method of claim 9, wherein the CNT yarn is woven around the protruding portions of the plurality of pegs to form a mesh network.

12. The method of claim 9, wherein affixing the CNT web to the bottom layer comprises applying an adhesive to at least one of the CNT web and the bottom layer.

13. The heating element of claim 1, wherein the bottom layer comprises a film adhesive, a pre-impregnated fabric, a polyimide, or a neoprene.

14. The heating element of claim 1, wherein the bottom layer is attached to an external surface of an aircraft component.

15. The heating element of claim 1, wherein the encapsulating layer comprises a film adhesive, a pre-impregnated fabric, a polyimide, or a neoprene.

16. The heating element of claim 1, wherein the encapsulating layer faces the breeze side of an aircraft component.

* * * * *